US006353993B1

(12) United States Patent
Schrader

(10) Patent No.: US 6,353,993 B1
(45) Date of Patent: Mar. 12, 2002

(54) CABLE FINISHING AND RESISTANCE TESTING MACHINE

(75) Inventor: William R Schrader, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/692,966

(22) Filed: Oct. 20, 2000

Related U.S. Application Data

(60) Provisional application No. 60/161,101, filed on Oct. 22, 1999.

(51) Int. Cl.[7] ..... H01R 43/00
(52) U.S. Cl. ..... 29/564.4; 29/33 M; 29/748
(58) Field of Search ..... 29/564.4, 564.6, 29/33 M, 33 F, 753, 748, 828, 566.3

(56) References Cited

U.S. PATENT DOCUMENTS 4,551,893 A * 11/1985 Ikeda et al. ..... 29/33 M
4,561,155 A * 12/1985 Randar et al. ..... 29/564.4 X
4,653,160 A * 3/1987 Thorkildsen et al. .. 29/564.6 X
4,733,463 A * 3/1988 Kolanowski et al. .. 29/33 M X
4,925,007 A * 5/1990 Gerst et al. ..... 29/753 X
5,230,147 A * 7/1993 Asaoka et al. ..... 29/748 X
5,305,508 A * 4/1994 Koch et al. ..... 29/33 M

FOREIGN PATENT DOCUMENTS

JP 6-111907 * 4/1994 ..... 29/33 M
JP 11-53964 * 2/1999 ..... 29/33 M

* cited by examiner

*Primary Examiner*—William Briggs
(74) *Attorney, Agent, or Firm*—Thomas A. Twomey

(57) ABSTRACT

A cable finishing and testing machine incorporates an electrical resistance testing station in a single automated process. The cable finishing and testing machine utilizes a conveyor belt to keep a terminated cable in an outstretched orientation as a trailing terminal of the terminated cable laterally transfers from one processing station to the next. A free or leading terminal of the terminated cable, being in a known sliding orientation upon the belt, is easily located and electrically engaged by a pick-up clamp device. A first indexing station electrically engages the trailing terminal and the electrical resistance of the terminated cable is measured. If the terminated cable tests bad, the terminated cable is automatically transferred to a second indexing station where it is destroyed and scrapped.

9 Claims, 5 Drawing Sheets

CABLE FINISHING AND RESISTANCE TESTING MACHINE

This application claims the benefit of U.S. provisional application No. 60/161, 101, filed Oct. 22, 1999, the disclosures of which are incorporated herein by reference in their entirety as if set forth at length.

TECHNICAL FIELD

This invention relates to a cable finishing machine, and more particularly to a combination cable finishing and testing machine for ignition cables.

BACKGROUND OF THE INVENTION

Automation of the manufacturing process for terminated cables such as ignition cables taken from a continuous spool of cable is known. One such automated machine is the "Megomat 3300 Cutting Machine" manufactured by Megomat Corporation, in Ruschlikon, Switzerland. The machine is capable of cutting a continuous cable to a predefined length, stripping the insulation or sheathing from either end, and crimping or pressing a unique terminal onto the respective ends of the cut length of cable. Such automation increases the efficiency of production and therefore reduces cost of the finished product.

With current industry initiatives or goals to increase quality in the manufacturing arena, a percentage of finished ignition cables must be tested for correct electrical resistance. The stricter the quality initiatives, the greater shall be the number of cables to be tested. Unfortunately, the testing process historically is performed manually. Terminated cables from the automated machines are taken by hand and installed on a resistance testing apparatus, measured and marked as good or bad. Such a process is time consuming and hinders the time saving advantages gained by the initial automated manufacturing process.

SUMMARY OF THE INVENTION

The invention provides a cable finishing and testing machine which cuts a length of cable, strips the ends, and terminates the cable at either end. The cable is automatically drawn from a continuous cable spool or dispenser via a cable drive unit. The cable lengths are measured by a cable length measuring device and guided into the cable apparatus. During processing of the cable, a conveyor belt is rotating with the top surface moving forward and away from the cable apparatus. The cable, outstretched upon the belt, remains in a straight configuration as the cable laterally transfers from one processing station to the next.

After the designated cable length is cut, stripped, and terminated, a first gripper assembly engages and laterally transfers a trailing end of the terminated cable to a resistance testing station. A first indexing station engages a trailing terminal of the terminated cable from the first gripper assembly thereby making an electrical connection. A pick-up clamp device lifts and engages a leading terminal off the conveyor belt thereby making an electrical connection. With the electrical connections completed, a controller tests the terminated cable for resistance and records as the cable as good or bad.

If good, the resistance testing station releases the terminated cable and stores it within a proper bin. If bad, a second gripper assembly laterally transfers the bad terminated cable from the first indexing station and off the belt to a second indexing station. A cutting device of the second indexing station destroys and discards the bad terminated cable.

A feature of the invention is that a terminated cable is automatically tested for electrical resistance directly on an automated manufacturing machine.

Another feature of the invention is that a terminated cable which does not pass the electrical resistance test is automatically destroyed.

These and other objects, features, and advantages of the invention will become more apparent from the following description of a preferred embodiment taken in conjunction with the accompanying drawings.

BRIEF DESCRIPTION OF THE DRAWINGS

The presently preferred embodiment of the invention is disclosed in the following descriptions and accompanying drawings, wherein.

DETAILED DESCRIPTION OF THE DEFFERED EMBODIMENT

Figure 1:
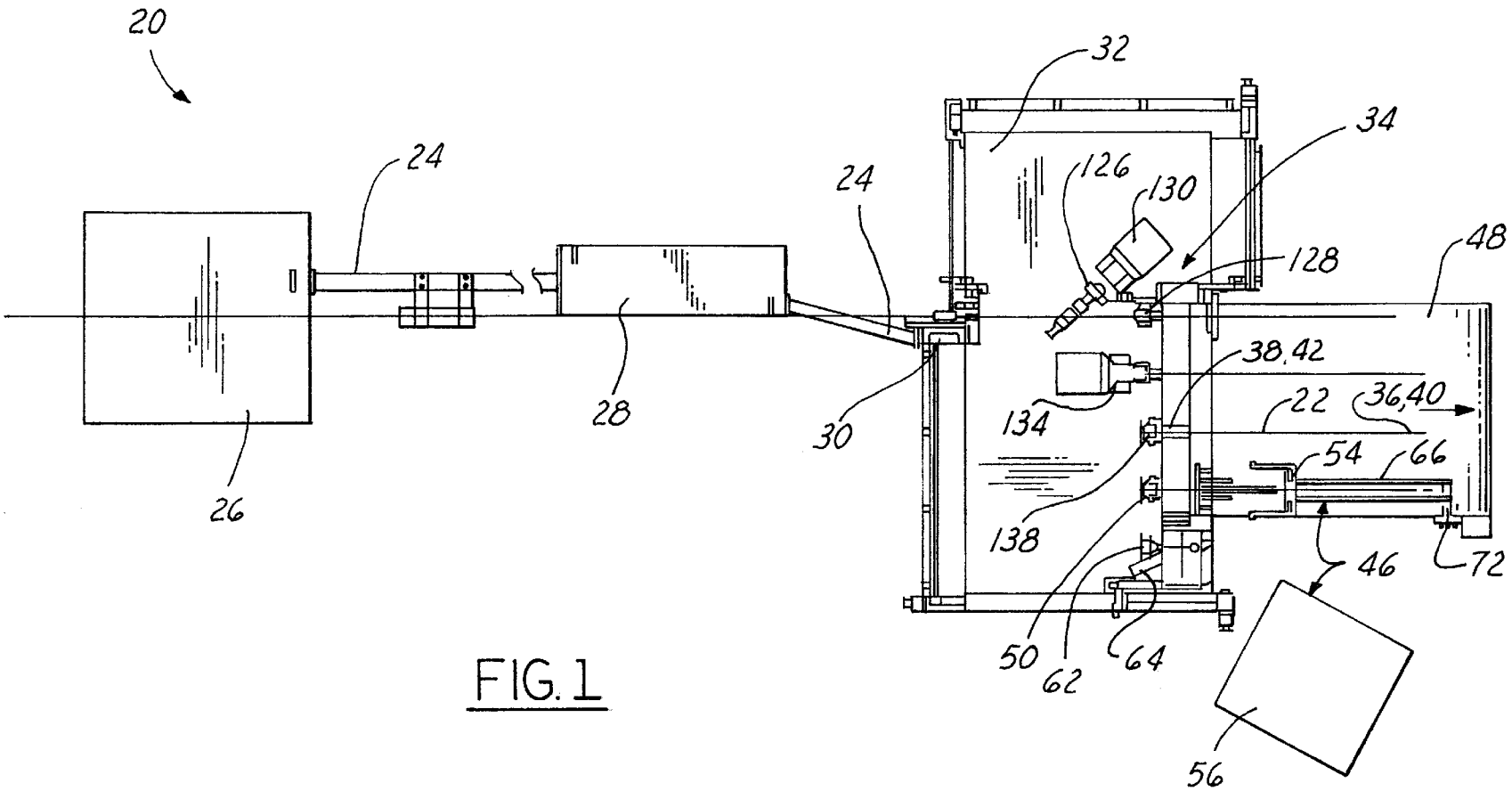
FIG. 1 is a top view of a cable finishing and testing machine of the present invention.
Figure 2:
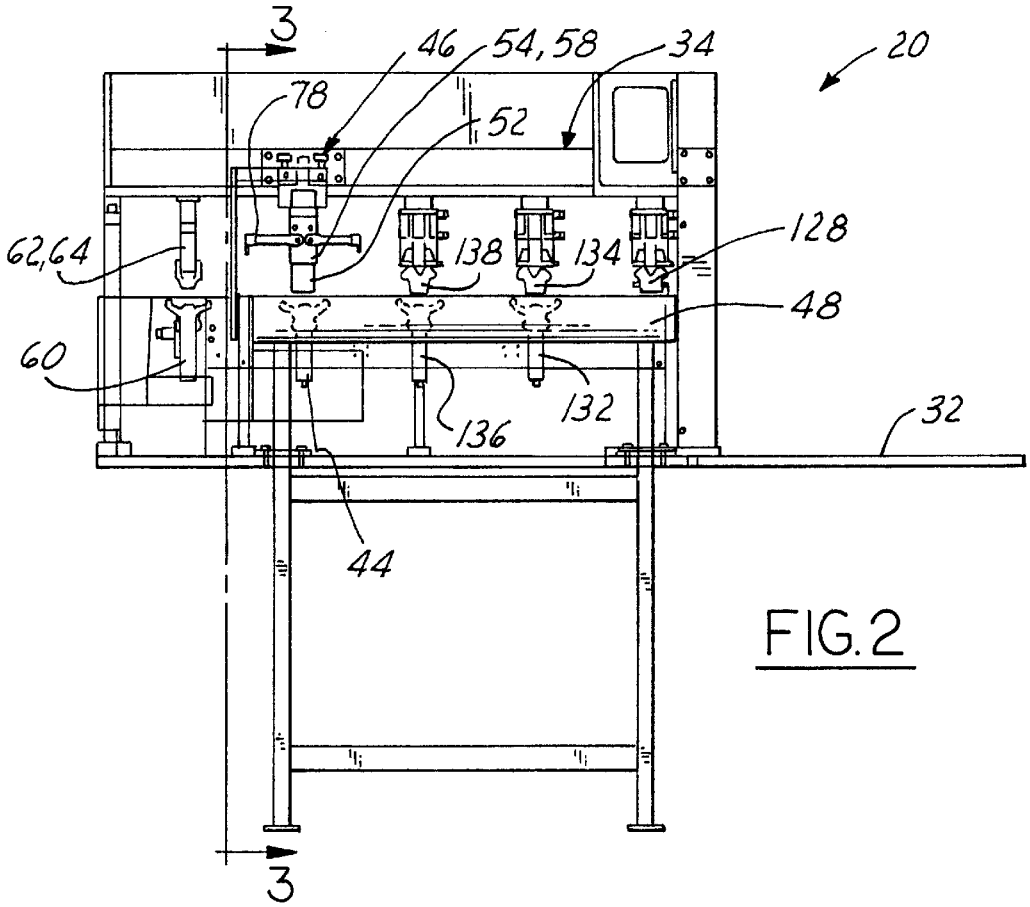
FIG. 2 is a front view of the cable finishing and testing machine.
Figure 3:
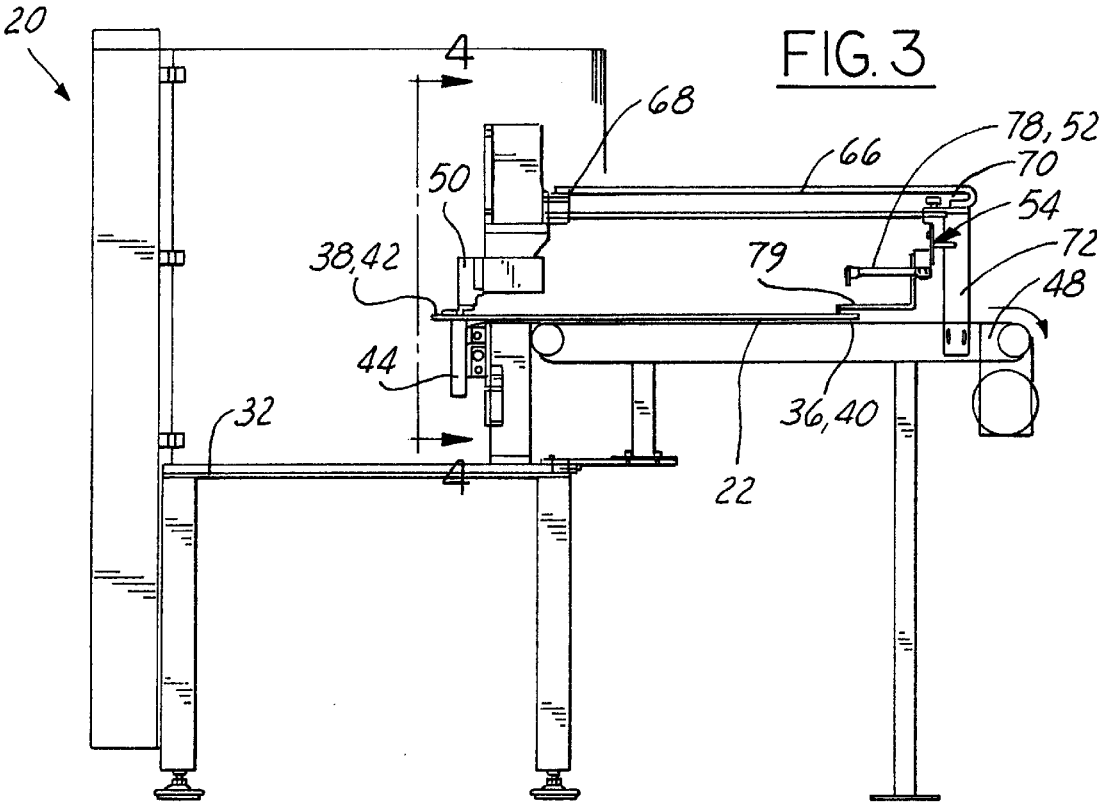
FIG. 3 is a side view of the cable finishing and testing machine taken along line 3—3 of FIG. 2 viewing in the direction of the arrows.
Figure 4:
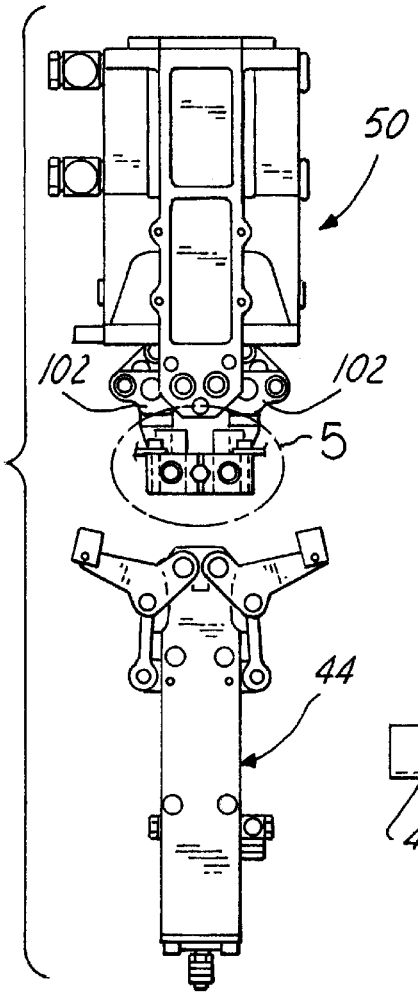
FIG. 4 is an enlarged rear view of a first indexing station in an engaged position and a first gripper assembly in a disengaged position taken along line 4—4 of FIG. 3 viewing in the direction of the arrows.
Figure 5:
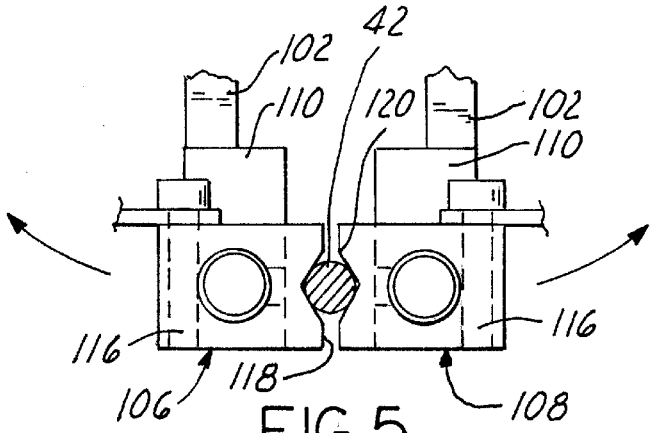
FIG. 5 is an enlarged rear view of a first foot and a cooperating second foot of the first indexing station taken from within the circle 5 of FIG. 4.
Figure 6:
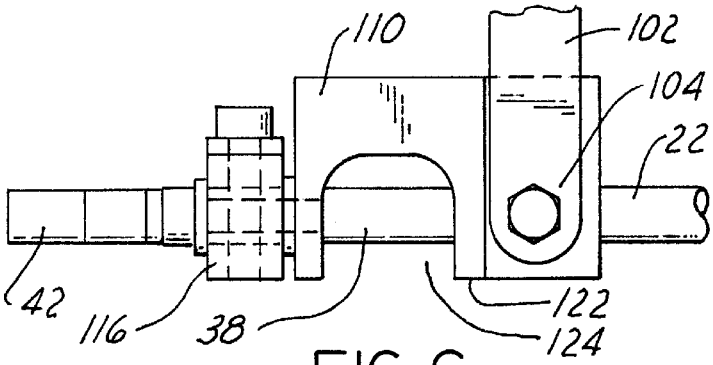
FIG. 6 is a side view of the second foot.
Figure 7:
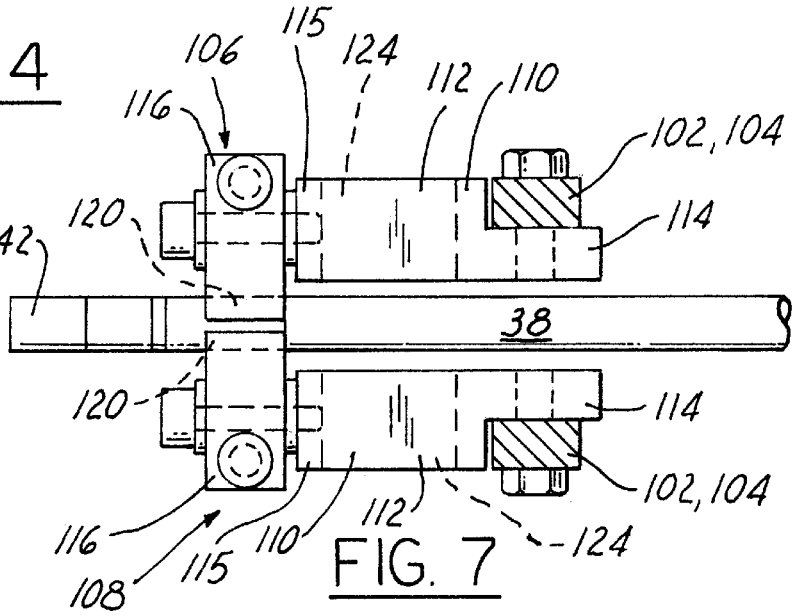
FIG. 7 is a top view of the first and second feet in the engaged position about a trailing end of a terminated cable.

Referring to FIGS. 1–3, a cable finishing and testing machine 20 is shown capable of manufacturing and testing the resistance of a terminated cable 22. A continuous cable 24 draws off of a cable dispenser or spool 26. The continuous cable 24 is pulled through a cable drive unit 28 into a cable length measuring device 30 mounted on a table 32 of the cable finishing and testing machine 20. The continuous cable 24 is preferably an ignition wire. From the cable length measuring device 30, the continuous cable 24 feeds through a finishing apparatus 34 for processing or manufacturing of the continuous cable 24 into the terminated cable 22. During processing, the continuous cable 24 is cut to a prescribed length forming a leading end 36 and a trailing end 38. In addition, the finishing apparatus 34 crimps or presses a leading terminal 40 to the leading end 36 and a trailing terminal 42 to the trailing end 38, thereby completing the terminated cable 22.

A first gripper assembly 44 laterally transfers the terminated cable 22 from the finishing apparatus 34 to a resistance testing station 46. The first gripper assembly 44 grips the trailing end 38 of the terminated cable 22 while the remaining length of the terminated cable 22 including the leading terminal 40 is outstretched upon a forward moving conveyor belt 48. The movement of the belt 48 is substantially perpendicular to the lateral movement of the first gripper assembly 44 from the finishing apparatus 34 to the resistance testing station 46. Conveyor belt 48 does not transport the cable during the manufacturing process along its forward moving direction, but assures that the terminated cable 22 remains in a consistent and straight orientation. In other words, the leading end 36 and leading terminal 40 of the terminated cable 22 are generally free to slide and move laterally upon the top of the belt 48 to a degree dictated by the restrictive lateral movement of the trailing end 38 and trailing terminal 42.

Referring to FIGS. 1, 2, 4, 9 and 10 a stationary first indexing station 50 of the resistance testing station 46 pneumatically pivots to an engaged position 52 and thereby grips the trailing terminal 42. After the first indexing station 50 engages the trailing terminal 42, the first gripper assembly 44 disposed beneath the first indexing station 50 releases the same trailing terminal 42 and laterally moves back to the finishing apparatus 34 to engage the next terminated cable 22. Within substantially the same time frame, a pick-up clamp device 54 of the resistance testing station 46 also pneumatically pivots to the engaged position 52 and thereby lifts and grips the free or leading terminal 40 off the conveyor belt 48. With the leading and trailing terminals 40,42 electrically engaged through the first indexing station 50 and the pick-up clamp device 54, a controller 56 tests the resistance across the entire terminated cable 22. After completion of the test, the controller 56 processes the data and causes the first indexing station 50 and the pick, up clamp device 54 to pivot to a disengaged position 58, thereby releasing the trailing and leading terminals 42, 40.

If the terminated cable 22 tests "good," the cable is released and travels down the conveyor belt 48 for packaging; if the terminated cable 22 tests "bad," the first indexing station 50 releases the trailing terminal 42 just after a second gripper assembly 60 grips the trailing end 38 of the faulty terminated cable 22. The second gripper assembly 60 laterally transfers the trailing end 38 to a second indexing station 62 of the resistance testing station 46. The second indexing station 62 grips the trailing end 38 while the leading end 36 pulls off the conveyor belt 48 from the side. The faulty terminated cable 22 pulls off the conveyor belt 48 because the width of the belt 48 does not extend laterally in front of the second indexing station 62. A cutting device 64 of the second indexing station 62 cuts or destroys the dangling faulty terminated cable 22 and discards. Preferably, the first and second indexing stations 50, 62, the first and second gripping assemblies 44, 60 and the cutting device 64 actuate pneumatically, each having pneumatic cylinders. However, these stations and assemblies may also be actuated utilizing conventional electromagnetic or motorized devices.

Figure 8:
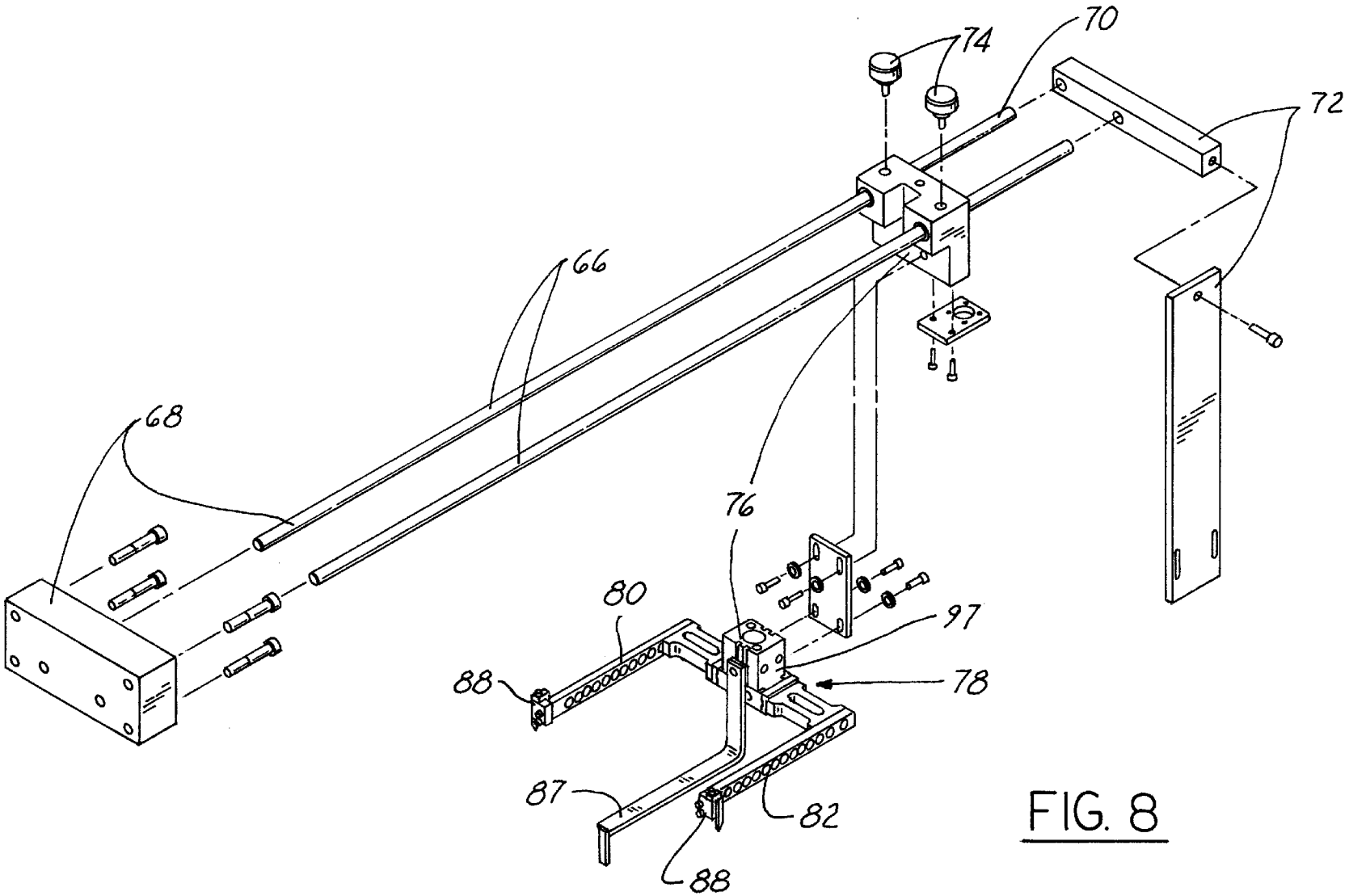
FIG. 8 is an exploded perspective view of a resistance testing station with a controller omitted.

Referring to FIGS. 3 and 8, extending above and substantially parallel to the longitude of the conveyor belt 48 is an elongated suspension member 66 of the resistance testing station 46. Member 66 has a rearward end 68 engaging rigidly to the stationary portion of the cable finishing and testing machine 20 rearward of the conveyor belt 48 and a forward end 70 disposed forward along the conveyor belt 48 length. The length of member 66 is greater than and dependent upon the maximum length of the terminated cable 22. A cantilevered structure 72 engages to the side of the cable finishing and testing machine 20 or a non-moving part of the side of the conveyor belt 48 and extends upward and over the belt 48 to engage and support the forward end 70 of the suspension member 66. The cantilevered structure resembles an L-shaped bracket.

The suspension member 66 may be a bar or a plurality of bars or rods having a consistent cross sectional area so that the pick-up clamp device 54 can engage and slide back and forth along its length. Preferably, the suspension member 66 comprises two parallel rods from which the pick-up clamp device 54 suspends. The suspension member 66 preferably is two rods because it is relatively light in weight, yet maintains a tight tolerance or orientation of the pick-up clamp device 54 to the belt 48 or first indexing station 50. The clamp device 54 is capable of slideable adjustment to conform to changing predefined terminated cable 22 lengths manufactured by the finishing apparatus 34. The pick-up clamp device 54 slides upon or about the suspension member 66 toward and away from the first indexing station 50. Two locking screws or knobs 74 thread through a housing 76 of the pick-up clamp device 54 and bear down upon the suspension member 66 thereby locking the pick-up clamp device 54 in place after adjustment.

Figure 9:
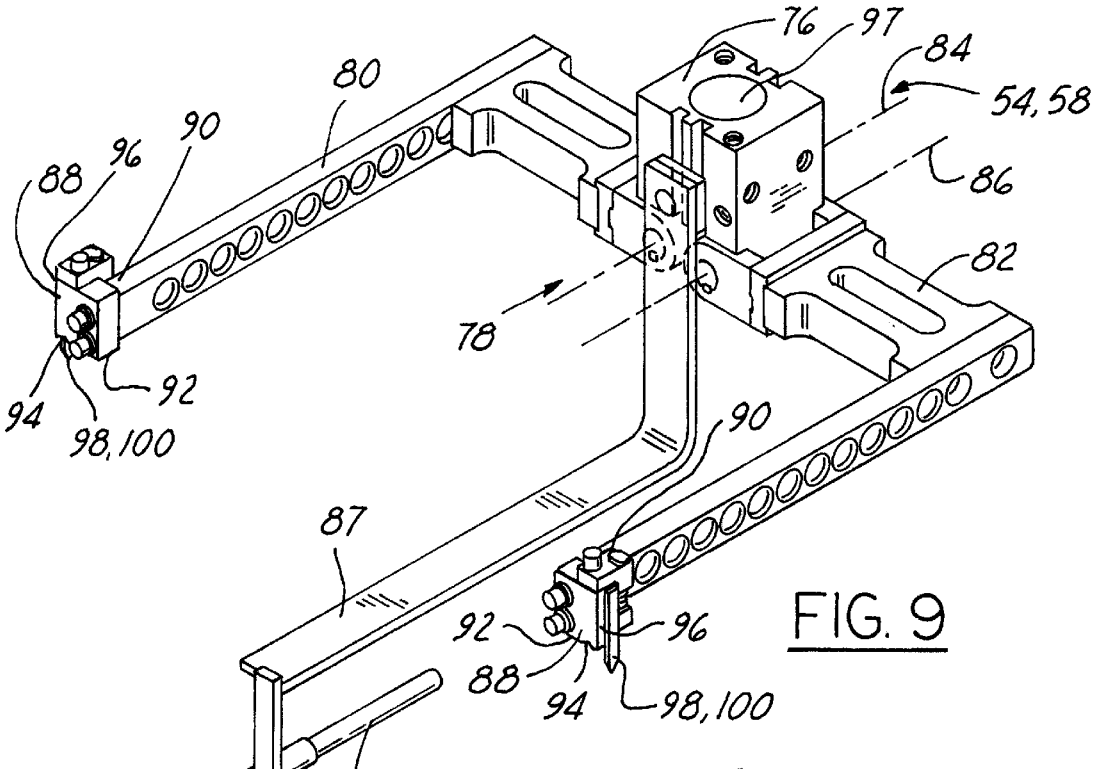
FIG. 9 is a perspective view of a pick-up clamp device of the resistance testing station in a disengaged position.
Figure 10:
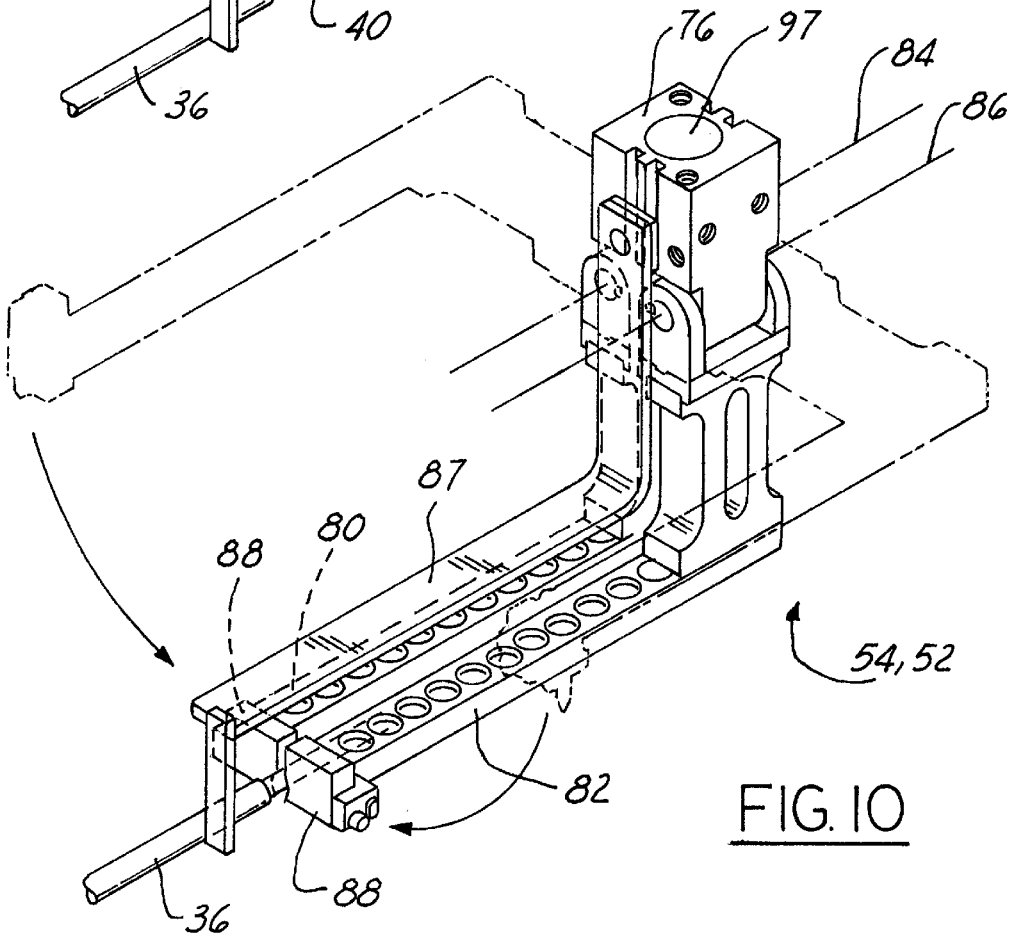
FIG. 10 is a perspective view of the pick-up clamp device of the resistance testing station in an engaged position about a leading end of the terminated cable.

Referring to FIGS. 8 through 10, suspending from the housing 76 is a cable pick-up jaw 78 having a first pivot arm 80 and a second pivot arm 82. The first and second pivot arms 80, 82 counter-pivot about respective parallel first and second pivot axes 84, 86, which are also substantially parallel to the suspension member 66. The counter pivoting action is produced by a conventional pneumatic rotary cylinder 97 contained within the housing 76. The first and second pivot arms 80, 82 can be any variety of shapes including a straight or preferably an L-shaped member. When the pick-up jaw 78 is in the open or disengaged position 58, the first and second pivot arm 80, 82 generally lie within a horizontal plane, substantially parallel to the belt. When the pick-up jaw 78 is in the closed or engaged position 52 the first and second pivot arms 80, 82 generally lie within respective parallel planes, both perpendicular to the belt 48.

Also suspending rigidly from the housing 76 is a stop guide 87 extending down toward the belt 48 and outstretched terminated cable 22. When the terminated cable 22 is laterally transferred from the finishing apparatus 34 to the first indexing station 50 by the trailing end 38, a whipping action of the leading end 36 is produced upon the moving conveyor belt 48. The whipping leading end 36 impacts the stop guide 87 held slightly above the moving belt 48 but below the upper portions of the terminated cable 22. The stop guide 87 stops the whipping or lateral oscillating movement of the leading end 36 thereby permitting a relatively quick pick-up of the leading terminal 40 by the pick-up jaw 78.

A paw 88 rigidly attaches to each distal end 90 of the first and second pivot arms 80, 82. Paw 88 extends slightly downward from the distal end 90 when the pick-up jaw 78 is in the disengaged position 58. A contact face 92 at an extended end of the paw 88 faces downward and defines a groove 94 extending through the paw 88 and disposed parallel to the suspension member 66 or outstretched terminated cable 22 secured to the first indexing station 50. Facing radially outward from the first and second pivot axis 84, 86 of each paw 88 is a longitudinal outward face 96. With respect to the pick-up jaw 78 in the disengaged position 58, engaging longitudinally to the outward face 96 and extending downward slightly beyond the contact face 92 is a claw 98.

Referring to FIGS. 9 and 10, a distal pointed end 100 of each claw 98 makes slight contact with the conveyor belt 48 when the pick-up jaw 78 is pivoting to the engaged position 52. The claws 98 thereby wedge themselves beneath the weight of the leading terminal 40 lifting the leading terminal 40 off the conveyor belt 48. So as not to damage the belt 48, the claw 98 is preferably made of a slightly resilient plastic material. As the pick-up jaw 78 continues to close, the leading terminal 40 is similarly wedged off the claws 98 by the contact faces 92 which define the grooves 94. The leading terminal 40 becomes embraced between the now facing contact faces 92 within the grooves 94 of the metallic and electrically conductive paws 88.

Referring to FIGS. 4 through 7, the first indexing station 50 has two conventional counter pivoting members 102 each having a distal end 104. Attaching rigidly to the distal ends 104 are respective first and second feet 106, 108. The novel first and second feet 106, 108 substantially extend perpendicular to the pivoting members 102 and in a rearward direction with respect to the conveyor belt 48. By extending rearward, the first and second feet 106, 108 will grip the trailing terminal 42 of the terminated cable 22 instead of a trailing end 38 insulated portion disposed forward of the trailing terminal 42. Each foot 106, 108 has an elongated cantilevered member 110 extending substantially parallel to the trailing terminal 42. The cantilevered member 110 has a mid portion 112 extending between a proximal end 114 and an extended end 115. The proximal end 114 attaches to the distal end 104 of the pivoting member 102. A grasping portion 116 of the feet 106, 108 engages to and extends perpendicularly from the extended end 115 of the cantilevered member 110.

When the counter pivoting members 102 are in the engaged position 52, the grasping portions 116 of the first and second feet 106, 108 extend horizontally toward one another and a distal face 118 of the first grasping portion 116 faces the distal face 118 of the second grasping portion 116. The distal face 118 defines a substantially horizontal groove 120 which extends through the grasping portion 116. The trailing terminal 42 snugly fits between the grooves 120 and is in conductive electrical contact with the distal faces 118 of the metallic grasping portions 116 when the counter pivoting members 102 are in the engaged position 52.

Extending through the mid portion 112 and defined by an underside 122 of the cantilevered member 110 is a channel 124. The channel 124 of the first foot 106 aligns with the channel 124 of the second foot 108 when the counter pivoting members 102 are in the engaged position 52. The first and second gripper assemblies 44, 60 acquire lateral access to the trailing end 38 of the terminated cable 22 via the aligning channels 124.

Referring to FIGS. 1 through 3, the initial processing operations performed by the finishing apparatus 34 of the cable finishing and testing machine 20 entails the feeding of the continuous cable 24 through a conventional third indexing station 126 and into a conventional fourth indexing station 128 from the length measuring device 30. U.S. Pat. No. 4,506,566, for a Cable Finishing Apparatus, granted to Hans Schmid, Mar. 26, 1985, and U.S. Pat. No. 4,616,386, for an Apparatus for Cutting and Preparing Cables, granted to Hans Schmid, Oct. 14, 1986 are hereby incorporated by reference as the patents relate to the finishing apparatus 34.

The continuous cable 24 is first cut and stripped within the fourth indexing station 128, thereby producing the stripped trailing end 38 and the stripped leading end 36 of two separate cables during the same operation. The third indexing station 126 rotates the leading end 36 of the continuous cable 24 to a terminal press 130 where the leading terminal 40 is pressed or crimped to the exposed wire of the leading end 36. The rotation process is necessary to gain access to the press 130 due to space restriction. The degrees of rotation is dependent upon space restrictions, and is preferable between forty-five to ninety degrees. After pressing, the terminated leading end 36 rotates back, feeds through the fourth indexing station 128 to length, and at the same time is outstretched upon the moving conveyor belt 48. The cutting and stripping process of the fourth indexing station 128 is repeated thereby stripping the trailing end 38.

A third gripper assembly 132 grips the trailing end 38 of the cut cable and laterally transfers the trailing end 38 to a fifth indexing station 134. The fifth indexing station 134 presses or crimps the trailing terminal 42 onto the stripped trailing end 38. A fourth gripper assembly 136 grips the trailing end 38 of the now terminated cable 22 and laterally transfers the trailing end 38 to a sixth indexing station 138 which is generally open or performs no specific operation to the terminated cable 22. The terminated cable 22 remains outstretched upon the moving conveyor belt 48. The first gripper assembly 44 retrieves the terminated cable 22 from the sixth gripper station 138 for resistance testing.

Although the preferred embodiment of the present invention has been disclosed, various changes and modifications may be made thereto by one skilled in the art without departing from the scope and spirit of the invention as set forth in the appended claims. It is also understood that the terms used herein are merely descriptive, rather than limiting, and various changes may be made without departing from the scope and spirit of the invention.

What is claimed is:

1. A cable finishing and testing machine for manufacturing and testing a terminated cable from a continuous cable, the terminated cable having a leading terminal crimped to a leading end and a trailing terminal crimped to a trailing end, the cable finishing and testing machine comprising:

a cable dispenser for dispensing the continuous cable;

a cable drive unit for drawing the continuous cable from the cable dispenser;

a cable length measuring device for measuring pre-determined lengths from the continuous cable;

a cable apparatus receiving the continuous cable from the cable length measuring device, the cable apparatus for cutting the continuous cable in pre-determined lengths, stripping the leading and trailing ends, crimping the leading terminal on the leading end, and crimping the trailing terminal on the trailing end of the cut and stripped-cable;

a conveyor belt upon which the cut cable is outstretched, the cable apparatus disposed rearward of the forward moving belt; and a resistance testing station having a first indexing station for engaging the trailing terminal of the terminated cable, a pick-up clamp device for engaging the leading terminal of the terminated cable thereby lifting the cable off the conveyor belt, and a controller for measuring terminated cable resistance and discarding faulty terminated cables, the pick-up clamp device disposed above the conveyor belt.

2. The cable finishing and testing machine as set forth in claim 1 further comprising a first gripper assembly for engaging the trailing terminal of the terminated cable and laterally moving the trailing terminal from the cable apparatus to the first indexing station, the terminated cable remaining outstretched upon the conveyor belt.

3. The cable finishing and testing machine as set forth in claim 2 further comprising:

the resistance testing station having a second indexing station for discard of faulty cables, the second indexing station having a cable cutting device to cut the faulty cables; and a second gripper assembly for engaging the trailing terminal of the resistance measured terminated cable and laterally moving the trailing terminal from the first indexing station to the second indexing station.

4. The cable finishing and testing machine as set forth in claim 3 wherein the pick-up clamp device comprises:

an elongated suspension member disposed above and parallel to the conveyor belt;

a housing slideably and adjustably engaged to the suspension member from beneath, the housing disposed above the conveyor belt, the housing having a rotary cylinder;

a stop guide engaged to and suspended downward from the housing, the stop guide for aligning the leading end of the terminated cable directly beneath the housing while the terminated cable is outstretched upon the moving belt; and a pivoting cable pick-up jaw engaged pivotally to the housing and actuated by the rotary cylinders.

5. The cable finishing and testing machine as set forth in claim 4 wherein the pick-up jaw has a first pivot arm pivoting about a first pivot axis and a second pivot arm pivoting about a second pivot axes, the first and second pivot axis parallel to the outstretched terminated cable.

6. The cable finishing and testing machine as set forth in claim 5 wherein the pick up jaw apparatus further comprises two paws, one paw disposed on a distal end of the first arm and one paw disposed on a distal end of the second arm, the paws each having a contact face mating when the pick-up jaw pivots to an engaged position, each contact face defining a groove, the grooves disposed parallel to the outstretched terminated cable, the leading terminal of the terminated cable disposed snugly between the grooves when the pick-up jaw is in the engaged position.

7. The cable finishing and testing machine as set forth in claim 6 wherein the pick-up jaw further comprises two claws each having distal pointed ends, each claw engaged to an outward face of each paw relative to the first and second pivot axes, the claws extending downward when the pick-up jaw is in a disengaged position, the pointed ends of each claw for lifting the leading terminal off the conveyor belt as the pick-up jaw pivots to the engaged position, the pointed ends disposed between the terminated cable and the conveyor belt when the pick-up jaw is in the engaged position.

8. The cable finishing and testing machine as set forth in claim 7 wherein the first indexing station has a first foot and a second foot, the first and second feet attached to the distal ends of two pivoting members, each foot having a groove parallel to the outstretched terminated cable, the trailing terminal engaged snugly between the first and second feet within the grooves when the pivoting members of the first indexing station are in the engaged position.

9. The cable finishing and testing machine as set forth in claim 8 wherein the first and second feet each further comprise:

an elongated cantilevered member extending parallel to the trailing terminal and perpendicular to the respective pivot member, the cantilevered member having a proximal end, a mid portion and an extended end, the proximal end engaged to the distal end of the respective pivot member, the mid portion having an underside defining a channel extending transversely through the cantilevered member, the underside facing downward and the channel of the first foot aligned longitudinally to the channel of the second foot when the first indexing station is in the engaged position; and a grasping portion engaged to the extended end, the grasping portion of the first foot extended toward the grasping portion of the second foot when the first indexing station is in the engaged position, the grasping portion having a distal face defining the grooves of the first and second feet, the distal face of the first foot facing the distal face of the second foot when the first indexing station is in the engaged position.

* * * * *